US010370808B2

(12) United States Patent
Neusch

(10) Patent No.: US 10,370,808 B2
(45) Date of Patent: Aug. 6, 2019

(54) MODULAR VEHICLE BARRIER

(71) Applicant: NEUSCH INNOVATIONS, LP, Marble Falls, TX (US)

(72) Inventor: William H. Neusch, Marble Falls, TX (US)

(73) Assignee: Neusch Innovations, LP, Marble Falls, TX (US)

( * ) Notice: Subject to any disclaimer, the term of this patent is extended or adjusted under 35 U.S.C. 154(b) by 0 days.

(21) Appl. No.: 16/104,714

(22) Filed: Aug. 17, 2018

(65) Prior Publication Data

US 2019/0055705 A1 Feb. 21, 2019

Related U.S. Application Data

(60) Provisional application No. 62/546,971, filed on Aug. 17, 2017.

(51) Int. Cl.
*E01F 13/00* (2006.01)
*E01F 13/12* (2006.01)
*E01F 13/02* (2006.01)

(52) U.S. Cl.
CPC ..... *E01F 13/12* (2013.01); *E01F 13/02* (2013.01)

(58) Field of Classification Search
CPC ..... E01F 13/12; E01F 13/02
USPC ..... 404/6, 72; 256/13.1
See application file for complete search history.

(56) References Cited

U.S. PATENT DOCUMENTS 4,854,767 A 8/1989 Sasaki
5,248,215 A 9/1993 Fladung
6,702,512 B1 3/2004 Reale
7,258,505 B2 * 8/2007 Dehart ..... E01F 13/12 256/13.1
7,494,112 B2 2/2009 Fromm
7,775,738 B2 8/2010 Darcy
7,850,391 B2 12/2010 Omar
7,918,622 B2 4/2011 Whitford
8,197,156 B2 * 6/2012 Morgan ..... E01F 13/12 256/13.1
8,215,866 B2 7/2012 Whitford
9,863,105 B1 1/2018 Price
9,951,488 B2 * 4/2018 Arciszewski ..... E01F 13/12
2012/0177439 A1 7/2012 More
2017/0204575 A1 7/2017 Lein

OTHER PUBLICATIONS

Security Snapshot, University of Southern Mississippi National Center for Spectator Sports Safety and Security, 2012.

* cited by examiner

*Primary Examiner* — Raymond W Addie

(74) *Attorney, Agent, or Firm* — Winstead PC; Henry Ehrlich

(57) ABSTRACT

An exemplary modular vehicle barrier includes a rigid, generally L-shaped frame having a base and an upright portion. The base including two or more joists spaced apart and extending orthogonal to a foot plate, wherein the foot plate is attached to a bottom surface at a front end of the two or more joists, the upright portion configured in a ladder arrangement having spaced apart vertical posts secured at bottom ends to a bottom beam and at top ends to a top beam, wherein the bottom beam is attached to a top surface at a back end of the two or more joists, and a wedge point formed the bottom surface of the second end of the two or more joists.

20 Claims, 8 Drawing Sheets

MODULAR VEHICLE BARRIER

BACKGROUND

This section provides background information to facilitate a better understanding of the various aspects of the disclosure. It should be understood that the statements in this section of this document are to be read in this light, and not as admissions of prior art.

Vehicle barrier systems are used to stop motor vehicles trying to forcibly gain access to a compound or facility. Anti-ram vehicle barriers (AVB) systems or vehicle security barriers (VSB) are configured to stop motor vehicles, such as trucks, that are intentionally crashed into the barrier in an attempt to breach the barrier. Passive barriers (e.g., fences, walls) are static after installation and deployment, in other words, passive barriers "never" allow vehicular access to certain areas, while active barriers (e.g., gates, drop arms, active wedges) control or limit vehicular access to a particular area.

Some anti-ram vehicle barriers are crash tested to ensure compliance with and obtain certification from a recognized standard. For example, the American Standard Test Method (ASTM F2656 Standard Test Method for Vehicle Crash Testing of Perimeter Barriers), British Standard Institute (PAS 68) and the International Organization for Standardization (ISO) and International Works Agreement (IWA 14-1).

The U.S. State Department (DOS) published the certification standard SD-STD-02.01 (Test Method for Vehicle Crash Testing of Perimeter Barriers and Gates) in 1985. The test vehicle was specified as a medium-duty truck weighing 15,000 lb. (6800 kg) and the nominal velocities were 30 mph (50 km/hr), 40 mph (65 km/hr) and 50 mph (80 km/hr). Penetration was measured from the pre-impact attack (front) side of the vehicle security barrier (VSB) and classified into three categories of penetration rating. In 2003, the standard was revised with measuring the penetration from the asset or protected (rear) side of the barrier and the limitation of permissible vehicle penetration to one meter (the highest level of penetration rating).

In 2007, the SD-STD-02.01 was replaced with ASTM F2656-07. This new standard included the medium-duty truck and added three new test vehicle types, a small passenger car, pickup truck, and heavy good truck. ASTM F2656-07 maintained three predetermined impact velocities for each vehicle category and the penetration is measured from the rear face of the barrier and classified into four categories of penetration rating. ASTM F2656 was revised in 2015 (ASTM F2656-15) to include two additional vehicle types, a full-sized sedan and a cab over/cab forward class 7 truck and it excluded the lowest penetration rating (P4).

The vehicle rating is designated with a prefix indicating the test vehicle weight: "M" prefix designates a medium duty vehicle with a gross weight of 15,000 pounds (6,810 kg), "C" prefix designates a car having a vehicle weight of 2,430 pounds (1,100 kg), "PU" prefix designates a pickup having a vehicle weight of 5,070 pounds (2,300 kg), and "H" prefix designates a heavy goods vehicle having a vehicle weight of 65,000 pounds (29,500 kg). The penetration ratings include P1 for less than or equal to 1 meter (3.3 ft); P2 for 1.10 to 7 m (3.31 to 23.0 ft); P3 for 7.01 to 30 m (23.1 to 98.4 ft); and, prior to 2015, P4 for 30 m (98 ft) or greater.

An ASTM F2656 crash tested vehicle barrier is rated based on the test vehicles weight (e.g., M, C, PU, H), the speed (miles per hour) of impact (e.g., 30, 40, 50, 60), and the penetration (P1, P2, P3, and P4) of the vehicle. For example, an M50-P1 crash barrier is designed to stop a medium duty truck traveling 50 mph with a penetration distance of 3.3 feet or less.

In 2005, the British Standard Institute (BSI) published PAS 68:2005 Specification for Vehicle Barriers: Fixed Bollards. The standard was expanded within two years to include other types of barriers, such as gates and road blockers. The 2013 version, "Impact Test Specifications for Vehicle Security Barrier Systems," rates vehicle barrier systems based on six types of test vehicles, including seven test speeds, and penetration is measured from the rear (protected side) face of the barrier. PAS 68 defines the vehicle type, penetration, dispersion of debris and records the angle of the vehicle's approach. The PAS 68 rating includes a 5 to 7 part classification code, the includes: Classification of Test/Gross Weight of Vehicle (kg) (Vehicle Class)/Impact Speed/Angle of Impact: Distance Leading Edge of Load Bay travels beyond the Original Position of Rear Face/Dispersion Distance of major debris weighing 25 kg or more from the barrier to establish standoff distance. For example, a barrier (bollard) tested by impact by a 7500 kg day cab ("V") at a ninety-degree angle traveling 80 km/hr and resulting in penetration of 7.5 m with significant debris scattered up to 20.0 m away would be designated as V/7500 (N3)/80/90:7.5/20.0. The dispersion distance may be utilized to determine a standoff distance for example to mitigate damage from a vehicle born improvised explosive device (VBIED).

The European Committee for Standardization (CEN), recognized across 34 European countries has produced a standard CWA 16221 that combines details of BS PAS 68 and PAS 69. PAS 69 provides guidance on the barrier's use and installation.

In 2013, the International Works Agreement (IWA) 14-1: 2013 was published to provide an international specification for crash testing. The system was developed by government agencies, military bodies and providing companies from the USA, UK, Germany, Norway, Oman, Singapore and Syria. This standard includes a merging of the British PAS 68 and the American ASTM F2656 vehicle impact test specifications. This international standard assesses vehicle barrier performance based on nine types of test vehicles with up to seven test speeds. Penetration is measured from the front (attack side) face of the vehicle safety barrier. The IWA 14-1 classification code represents Vehicle Impact Test/Gross Weight of Vehicle (Vehicle Class)/Impact Speed/Angle of Impact/Penetration beyond the original position of the front/impact face.

Many different types of passive and active AVB systems are available or permanent sites. However, few anti-ram vehicle barriers are available for use at temporary sites such as fairs, street parties, sporting events, and the like.

SUMMARY

An exemplary modular vehicle barrier includes a rigid, generally L-shaped frame having a base and an upright portion. the base including two or more joists spaced apart and extending orthogonal to a foot plate, wherein the foot plate is attached to a bottom surface at a front end of the two or more joists, the upright portion configured in a ladder arrangement having spaced apart vertical posts secured at bottom ends to a bottom beam and at top ends to a top beam, wherein the bottom beam is attached to a top surface at a back end of the two or more joists, and a wedge point formed at bottom surface of the back end of the two or more joists.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion. As will be understood by those skilled in the art with the benefit of this disclosure, elements and arrangements of the various figures can be used together and in configurations not specifically illustrated without departing from the scope of this disclosure.

DETAILED DESCRIPTION

Figure 1:
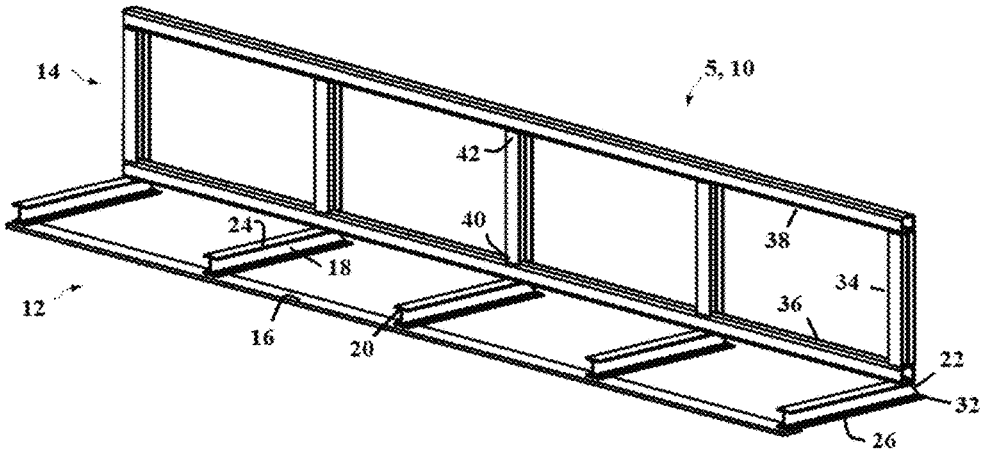
FIG. 1 illustrates an exemplary modular vehicle barrier according to one or more aspects of the disclosure.

It is to be understood that the following disclosure provides many different embodiments, or examples, for implementing different features of various illustrative embodiments. Specific examples of components and arrangements are described below to simplify the disclosure. These are, of course, merely examples and are not intended to be limiting. For example, a figure may illustrate an exemplary embodiment with multiple features or combinations of features that are not required in one or more other embodiments and thus a figure may disclose one or more embodiments that have fewer features or a different combination of features than the illustrated embodiment. Embodiments may include some but not all the features illustrated in a figure and some embodiments may combine features illustrated in one figure with features illustrated in another figure. Therefore, combinations of features disclosed in the following detailed description may not be necessary to practice the teachings in the broadest sense and are instead merely to describe particularly representative examples. In addition, the disclosure may repeat reference numerals and/or letters in the various examples. This repetition is for the purpose of simplicity and clarity and does not itself dictate a relationship between the various embodiments and/or configurations discussed.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include such elements or features.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms such as "inboard," "outboard, "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction. As used herein, the terms "connect," "connection," "connected," "in connection with," and "connecting" may be used to mean in direct connection with or in connection with via one or more elements. Similarly, the terms "couple," "coupling," and "coupled" may be used to mean directly coupled or coupled via one or more elements.

Often times it is desirable to put up temporary passive vehicle anti-ram barriers at events (e.g., sporting events, concerts, festivals, etc.). Some public events can be quite large, covering a lot of acreage. Thus, an amount of temporary barrier or fencing used can be quite large. Temporary barriers that provide protection from vehicle impacts and other forces (e.g., pushing by a crowd of people) that might move or alter the positioning of temporary barriers can be heavy, large, and difficult to transport to the event and to setup at the event. A modular vehicle barrier is disclosed herein that can withstand vehicle impacts and allows for a reduction in transportation and setup costs. Transportation costs can be reduced by managing a weight of the modular vehicle barrier and utilizing an ability of the modular vehicle barrier to efficiently stack to maximize a number of the modular vehicle barrier that may be transported in a given space without exceeding transportation restrictions (e.g., highway weight restrictions). Setup costs can be reduced by reducing the weight of the modular vehicle barrier, which makes it easier to handle the modular vehicle barrier, and thus reduces labor costs to set up the modular vehicle barrier.

In accordance with embodiments of the disclosure, the portable gate assemblies are configured to provide a requisite stopping capability in the event that a motor vehicle, such as a 15,000 pounds (6.8 metric tons) medium-duty truck, crashes into the portable gate. In accordance with embodiments of the disclosure, a requisite stopping capability will be in accordance with standards established for example by ASTM F-2656, which identifies impact conditions including the vehicle weight, impact velocity, and penetration distance. With reference to a medium-duty truck, having a weight of about 15,000 lb. (6,800 kg), the speed ratings include M30 for traveling at 28.0 to 37.9 miles per hour (mph), M40 traveling at 38.0 to 46.9 mph, and M50 traveling at 47.0 mph and above. The penetration ratings include P1 for less than or equal to 1 meter (3.3 ft); P2 for 1.10 to 7 m (3.31 to 23.0 ft); and P3 for 7.01 to 30 m (23.1 to 98.4 ft). For example, an ASTM F2656 crash-rated M50-P1 barrier is designed to stop a medium duty truck traveling 50 mph with a penetration distance of 3.3 feet or less.

In accordance with at least one embodiment, the modular vehicle barrier is configured to achieve an M30 speed rating with a P1 penetration rating. In accordance with at least one embodiment, the modular vehicle barrier is configured to achieve an M30 speed rating with a P2 penetration rating. In accordance with at least one embodiment, the modular vehicle barrier is configured to achieve a M30 speed rating with a P3 penetration rating.

In accordance with at least one embodiment, the modular vehicle barrier is configured to achieve an M40 speed rating with a P1 penetration rating. In accordance with at least one embodiment, the modular vehicle barrier is configured to achieve an M40 speed rating with a P2 penetration rating. In accordance with at least one embodiment, the modular vehicle barrier is configured to achieve an M40 speed rating with a P3 penetration rating.

In accordance with at least one embodiment, the modular vehicle barrier is configured to achieve an M50 speed rating with a P1 penetration rating. In accordance with at least one embodiment, the modular vehicle barrier is configured to achieve an M50 speed rating with a P2 penetration rating. In accordance with at least one embodiment, the modular vehicle barrier is configured to achieve an M50 speed rating with a P3 penetration rating.

Some embodiments may be configured to achieve similar speed and penetration ratings for impact vehicles such as cars having a weight up to about 2,430 lb. (1,100 kg) (e.g., C40, C50, C60) and heavy goods vehicles having a weight of about 65,000 lbs (29,500 kg) (e.g., H30, H40, H50).

FIGS. 1-4 illustrate multiple views of a single unit 5 of an exemplary modular vehicle barrier (MVB) denoted generally by the numeral 10. Single units 5 may be deployed as a stand-alone vehicle crash barrier or units 5 may be interconnected to form a continuous length vehicle crash barrier. In some aspects, MVB 10 may be arranged to generally form a line or wall blocking access to a protected area or may be used to form a perimeter around a protected area. In at least one embodiment, MVB 10 illustrated in FIGS. 1-4 is configured to achieve a crash rating in accordance with ASTM F2656. In an embodiment, a stand-alone MVB unit 5 is configured to achieve a crash rating in accordance with ASTM F2656. An embodiment of MVB 10, is crash certified M30 P2 under ASTM F2656 as a stand-along MVB unit 5.

MVB 10 is a rigid, generally L-shaped framework having a base 12 and an upright portion 14 configured to sit directly on a ground surface 7, e.g., grade, without being anchored to the ground to provide crash barrier protection. In an exemplary embodiment, upright portion 14 is configured to extend perpendicular to grade 7 and offset from perpendicular relative to base 12, see, e.g., FIG. 4. The depicted MVB 10 is constructed of metal, e.g. steel.

Base 12 includes a laterally extending foot plate 16 and two or more base joists 18 spaced apart and orthogonal to foot plate 16. Base joists 18 are linear members, e.g., I-beams, hollow tubular steel, extending from a front end 20 to a back end 22. Foot plate 16 is secured, e.g. by welding, to the bottom surface 24 of joists 18 at front end 20. Upright portion 14 is secured, e.g. by welding, to the top surface 26 of joists 18 at back end 22. In use, upright portion 14 separates the protected side 28 from the attack side 30 with front end 20 facing away from the protected side 28. Protected side 28 is associated with the area to be protected from approaching motor vehicles and attack side 30 is the side from which the vehicles are approaching protected side 28.

Foot plate 16 does not extend from front end 20 to back end 22 of joists 18. For example, in FIGS. 1-4, foot plate 16 is a 20 foot long, 5.5 inch deep, 0.75 inch high, steel flat bar, e.g., ASTM A36 steel. In the embodiment of FIGS. 1-4, a front portion **16*a* of foot plate 16 extends beyond front end 20 of joists 18, for example two inches in FIG. 4. Foot plate 16 elevates front end 20 of joist 18 relative to back end 22, thus joist 18 is not parallel to grade 7**.

Figure 4:
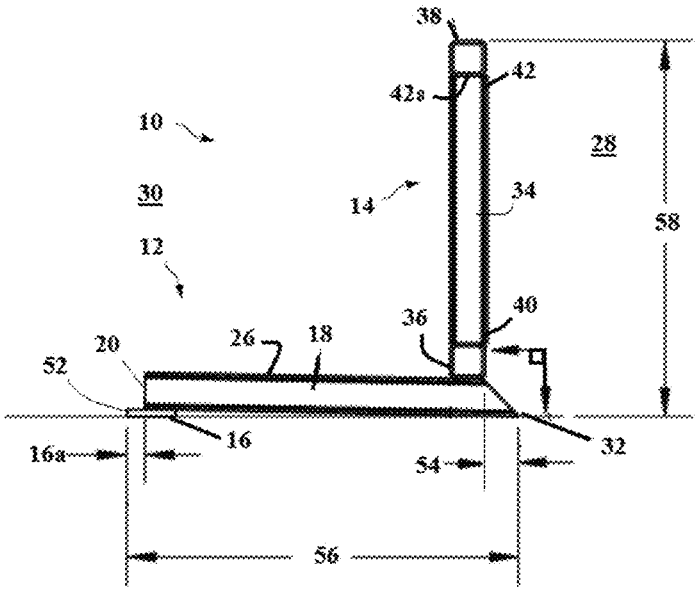
FIG. 4 illustrates a side view of the modular vehicle barrier of FIG. 1.
Figure 2:
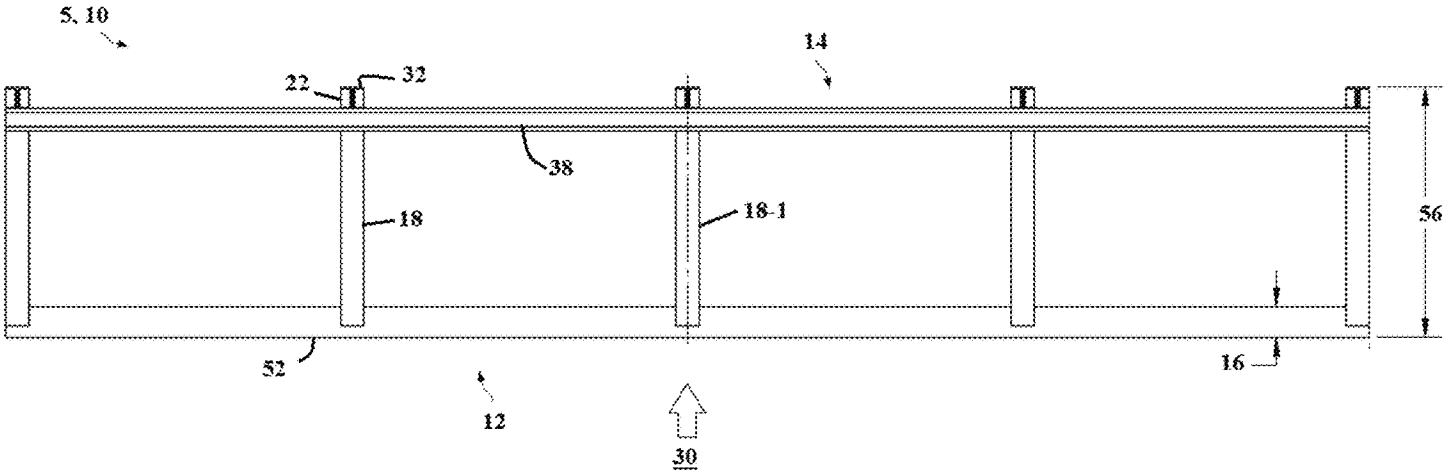
FIG. 2 illustrates a plan view of the modular vehicle barrier of FIG. 1.
Figure 3:
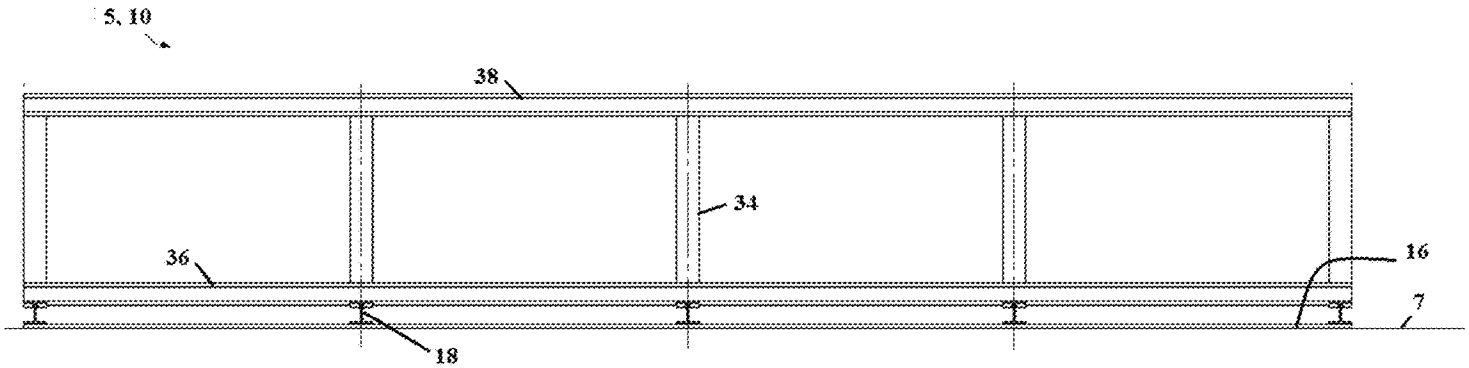
FIG. 3 illustrates a front view of the modular vehicle barrier of FIG. 1.

MVB 10 has a wedge point 32 at bottom surface 24 of back end 22, which is configured to dig into ground surface 7 as MVB 10 rolls underneath an attacking vehicle. Wedge point 32 is positioned behind upper portion 14 a distance 54 as shown in particular in FIG. 4. Accordingly, upper portion 14 is attached to top surface 26 joists 18 forward of wedge point 32. In FIG. 4, wedge point 32 is formed by non-right angle cut, e.g., a 45 degree cut, along back end 22. Wedge point 32 is not limited to a 45 angle or to a non-right angle. In at least one embodiment, back end 22 is generally planar and wedge point 32 is formed by a right-angle back end 22.

Upper portion 14 is configured in a ladder arrangement having spaced apart vertical posts 34 secured at their opposing ends to laterally extending bottom beam 36 and top beam 38. Bottom beam 36 is secured, e.g., by welding, to the bottom end 40 of posts 34 and aligned in the same vertical plane as vertical posts 34. Top beam 38 is secured, e.g., by welding, to the top end 42 of posts 34. In FIGS. 1-4, top beam 38 is attached to the top surface **42*a* of top end 42 and aligned in the same vertical plane as vertical posts 34 and bottom beam 36. In some embodiments, one or more of top and bottom beams 36, 38 may be in different planes from vertical posts 14. For example, in an exemplary embodiment illustrated in FIGS. 6 and 7, top beam 38 is secured to the front surface 34*a* of posts 34 and aligned in a different vertical plane from posts 34**.

The exemplary embodiment illustrated in FIGS. 1-4, is a 20 foot long MVB unit 5. MVB units 5 are not limited to 20 foot lengths. In this example, foot plate 16 is a single 20 foot long 20 foot long, 5.5 inch deep, 0.75 inch high, ASTM A36 steel flat bar to which front end 20 of each of five base joists 18 (42 in., W4×13 ASTM A992 steel I-beams) are welded perpendicular. Spacing for base joists 18 is a middle joist 18-1 (FIG. 2) on a unit 5 centerline, the two inner joists 18 at 59 inches on-center from middle joist 18-1 and the two end joists 18 at 61 inches on-center. Upper portion 14 is constructed of steel I-beam and square tubing. Top and bottom beams 36, 38 are 20 foot long, 4 in. by 4-in by 0.375 inch wall thickness ASTM A36 steel tube. Five vertical posts 34 are constructed of 30 inch W4×13 ASTM A992 steel I-beam on the same spacing as base joints 18. In this example, MVB 10 and base 12 extends 44 inches (distance 56) from wedge point 32 to a front terminal end 52, which is an end of portion **16*a* of foot plate 16, and MVB 10 extends vertically (distance 58) of about 42 inches above wedge point 32. In some embodiments, front terminal end 52 is front end 20. Terminal end 52 is configured to engage the undercarriage of vehicle that impacts MVB 10 from attack side 30 and rolls MVB 10 about wedge point 32**.

A single MVB unit 5 according to the modular vehicle barrier 10 illustrated in FIGS. 1-4 was subjected to testing according to ASTM standard F2656-07, Standard Test Method for Vehicle Crash Testing of Perimeter Barriers. The objective of the test was to determine a penetration rating for the modular vehicle barrier for a nominal 15,000 pound vehicle at 30 mph. In accordance with the test procedure, the modular vehicle barrier was impacted at a velocity of 29.52 mph by a medium duty truck whose test weight was 14,885 lbs. MVB 10 provided an M30 static stopping distance of 6.485 meters and 6.705 meters (left and right side of the truck bed leading edge, respectively) past the trailing edge of the impacted element for a P2 penetration rating.

The result of the interaction between the test vehicle and modular vehicle barrier 10 was that the test vehicle's forward motion was arrested by the modular vehicle barrier. At initial impact the test vehicle's engine cowl made contact with upright portion 14 of modular vehicle barrier 10. As the test vehicle continued to move forward, the entire modular vehicle barrier 10 rolled forward underneath the test vehicle's front wheels as the bottom of modular vehicle barrier 10 dug into the road surface 7. At approximately 90 degrees of rotation of modular vehicle barrier 10, the test vehicle was propelled upwards and forwards as the terminal end of the base of modular vehicle barrier 10 contacted the undercarriage of the test vehicle. At this point in the event the test vehicle's engine cowl became detached from the test vehicle and the test vehicle's cab rotated slightly forward. As the test vehicle and the modular vehicle barrier continued to move forward, the front of the test vehicle came to rest on top of the modular vehicle barrier and they both continued to move forward together until they both came to a stop at a point between the P1 and P2 penetration lines, thus resulting in the P2 rating.

Figure 5:
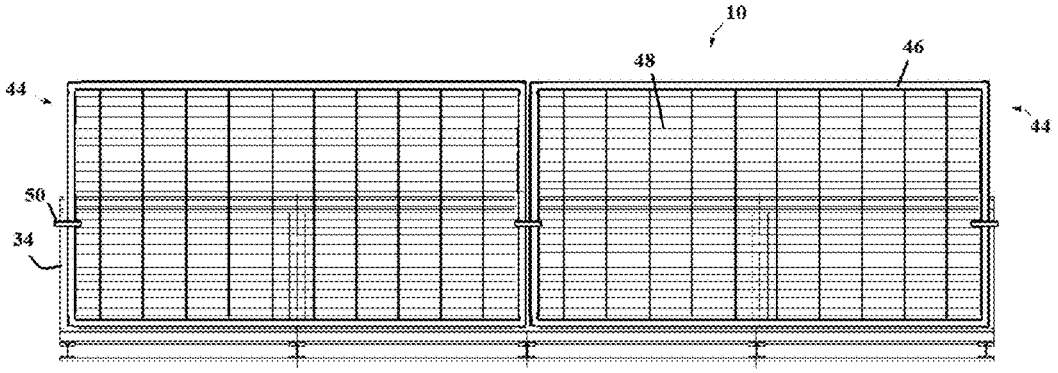
FIG. 5 illustrates a modular vehicle barrier with a fence panel attached thereto according to one or more aspects of the disclosure.

FIG. 5 illustrates an example of an MVB 10 with a pedestrian fence panel 44 attached. Fence panel 44 includes for example an outer frame 46 carrying wire screen 48. Fence panels 44 are secured to MVB 10 by attachments 50. For example, attachments 50 are illustrated as U-bolts securing frame 46 to posts 34.

Figure 6:
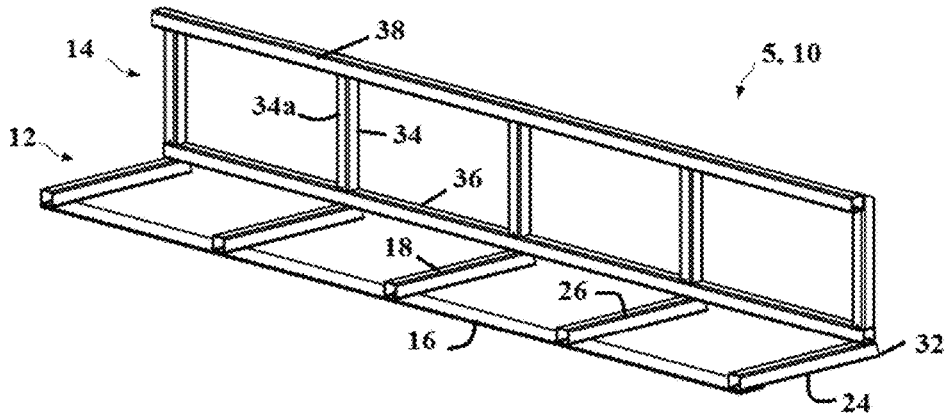
FIG. 6 illustrates another exemplary modular vehicle barrier according to one or more aspects of the disclosure.
Figure 7:
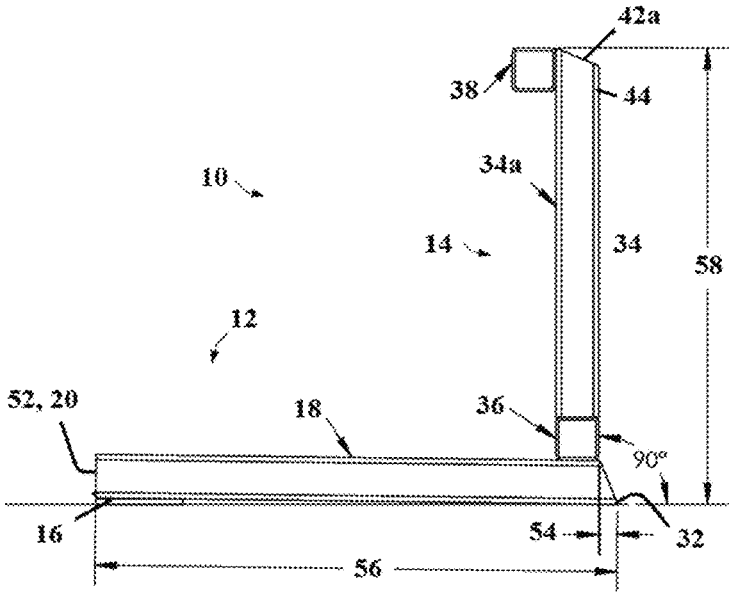
FIG. 7 is a side view of the modular vehicle barrier of FIG. 6.
Figure 8:
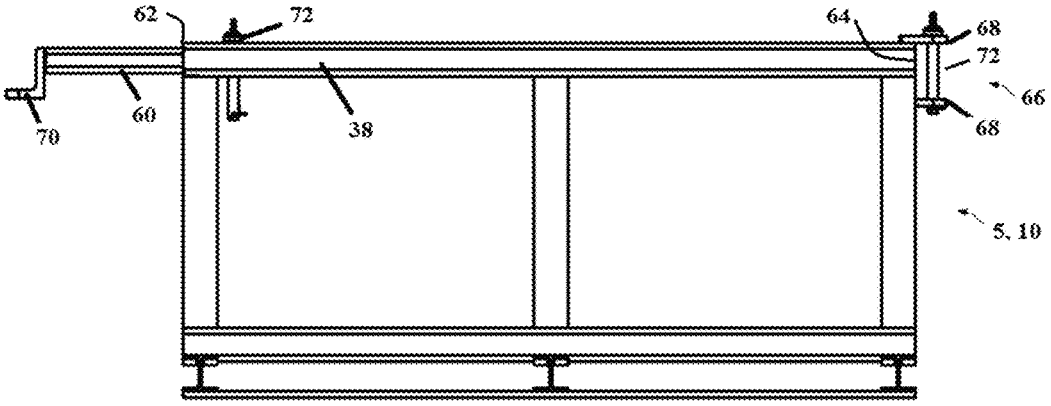
FIG. 8 illustrates an exemplary single modular vehicle barrier unit according to one or more aspects of the disclosure.

FIGS. 6 and 7 illustrate another exemplary embodiment of a single unit 5 of a modular vehicle barrier 10. MVB 10 is a rigid, generally L-shaped framework having a base 12 and an upright portion 14 configured to sit directly on a ground surface 7, e.g., grade, without being anchored to the ground to provide crash barrier protection. Base joists 18 are spaced apart and orthogonal to foot plate 16. Base joists 18 are attached at bottom surface 24 of front end 20 to foot plate 16. In this exemplary embodiment, a front edge of foot plate 16 is generally in-line with front end 20 of joist 18 to form front terminal end 52. The width, or depth, of foot plate 16 does not extend the full length of base joists 18 and foot plate 16 has a height that elevates front end 20 above back end 22, in particular wedge point 32. In this example, wedge point 32 is a non-right angle at bottom surface 24 of back end 22 and wedge point 32 is located a distance 54 behind upper portion 14. In a non-limiting example, distance 54 is 0.375 inches. Distance 54 may be determined by the non-right angle cut of back end 22 to form wedge point 32 or a selected distance to position upper portion 34 forward of wedge point 32 when wedge point is a right angle.

Upper portion 14 is configured in a ladder arrangement having spaced apart vertical posts 34 secured at their opposing ends to laterally extending bottom beam 36 and top beam 38. Bottom beam 36 is secured, e.g., by welding, to the bottom end 40 of posts 34 and aligned in the same vertical plane as vertical posts 34. Top beam 38 is secured, e.g., by welding, to a front surface 34*a* of post 34 proximate top end 42 and is positioned in a different vertical plane from posts 34 and bottom beam 36. Top surface 42*a* of vertical posts 34 may be cut at a non-right angle as illustrated for example in FIG. 6.

In an exemplary embodiment described with reference to FIGS. 6 and 7, a 20 foot MVB unit 5 includes a foot plate 16 constructed of a 20 foot long, 8 inch deep, 0.5 inch high, ASTM A36 steel flat bar to which front end 20 of each of five 48 inch long base joists 18 constructed of 4 in. by 4 in. by 0.25 inch sidewall tubular steel. Spacing for base joists 18, in this 20 foot exemplary embodiment, is a middle joist 18-1 (FIG. 6) on a centerline of unit 5, the two inner joists 18 at 59 inches on-center from middle joist 18-1 and the two end joists 18 at 61 inches on-center. Top and bottom beams 36, 38 are 20 foot long, 4 in. by 4-in by 0.25 inch wall thickness ASTM A36 steel tube. Five vertical posts 34 are constructed of 34 inch long, 4 in. by 4-in by 0.25 inch wall thickness ASTM A36 steel tube on the same spacing as base joints 18. MVB 10 has a vertical height of about 42 inches (distance 58) above grade 7 and wedge point 32. In this example, MVB 10 has a horizontal depth (distance 56) of 44 inches from wedge point 32 to a front terminal end 52 of base 12, which in FIGS. 6 and 7 is front end 20. In FIGS. 1-4, terminal end 52 is portion 16*a* extending beyond front end 20.

Figure 9:
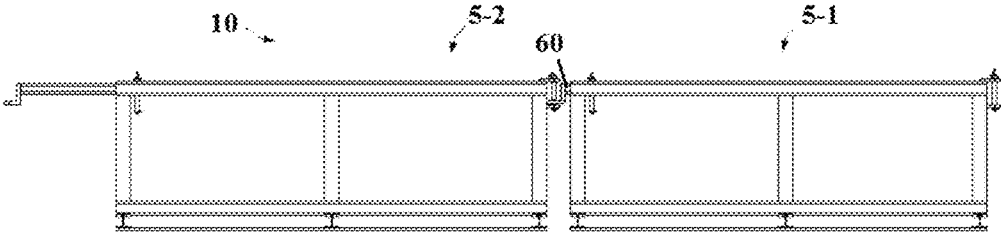
FIGS. 9 to 11 illustrate examples of interconnecting adjacent modular vehicle barrier units according to one or more aspects of the disclosure.
Figure 10:
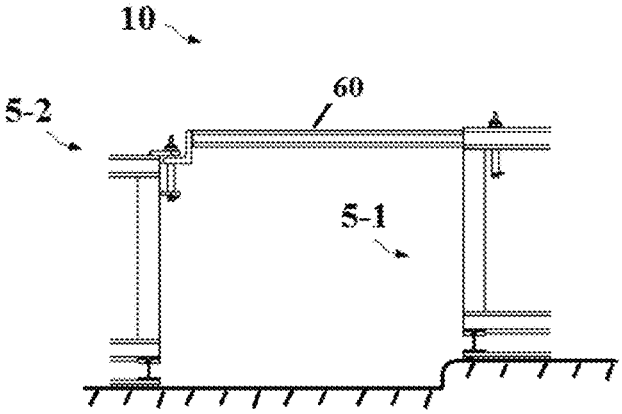
Figure 11:
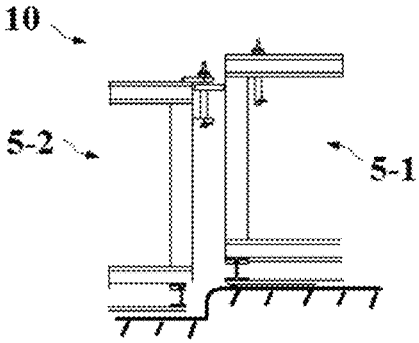

FIGS. 8-11 illustrate an exemplary embodiment of a unit 5 of a MVB 10 configured for interconnecting with adjacent units 5. Top beam 38 is constructed of hollow tubular steel and includes a steel extension arm 60 that is slidably disposed in a first end 62 of top beam 38. The opposite second end 64 of upper portion 14 includes a connector 66 including vertically spaced apart connector plate 68. Extension arm 60 includes a male plate 70 for operationally mating with connector 66 of unit 5-2. As shown in FIGS. 9-11, extension arm 60 is positioned laterally relative to first unit 5-1 and secured to unit 5-1 by lock 72, e.g., pin, and male plate 70 is secured to connector 66 by a lock 72, e.g., pin. Connector plates 68 are vertically spaced apart a distance to allow male connector 70 to move vertically so that adjacent units 5-1 and 5-2 can be positioned on different elevations of ground 7.

Figure 12:
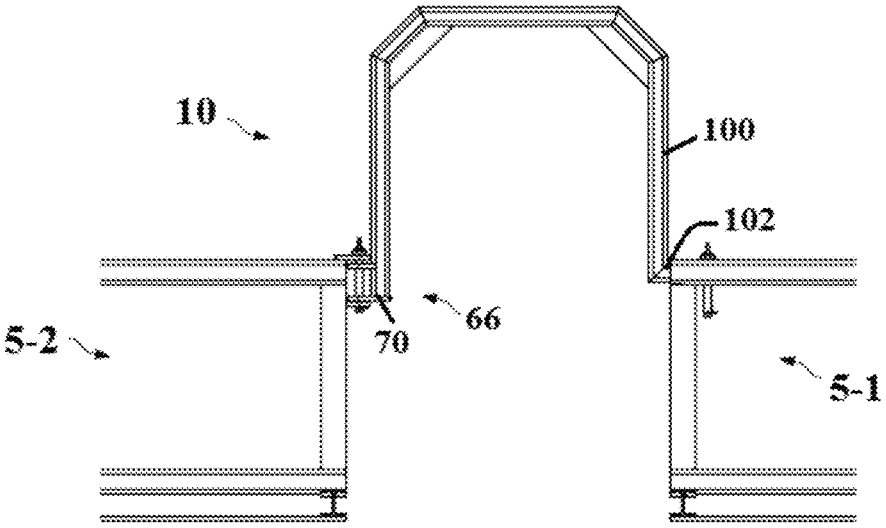
FIG. 12 illustrates an exemplary modular vehicle barrier with a pedestrian walkway.

FIG. 12 illustrates an example of adjacent units 5-1 and 5-2 interconnected by a pedestrian arch 100. Pedestrian arch 100 replaces an extension arm 60 (FIGS. 8-12) includes an arm end 102 disposed in top beam 38 of unit 5-1 and the opposite end has a male plate 70 connected to connector 66 of unit 5-2.

Figure 13:
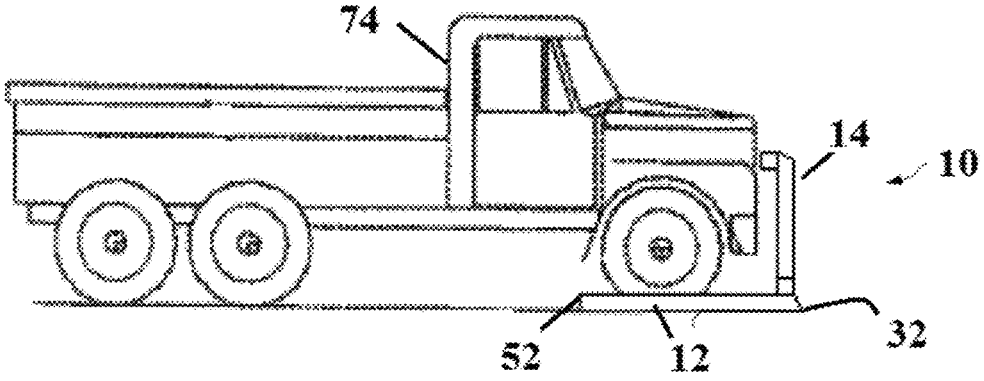
FIGS. 13 to 15 illustrate a modular vehicle barrier rolling in response to impact by a motor vehicle.
Figure 14:
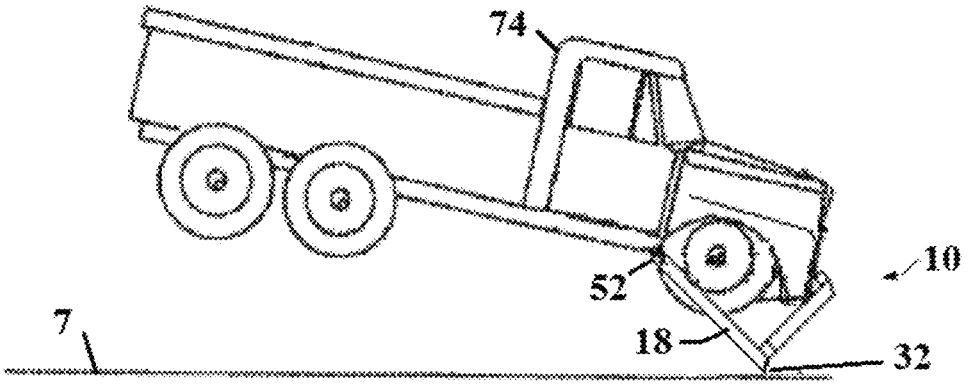
Figure 15:
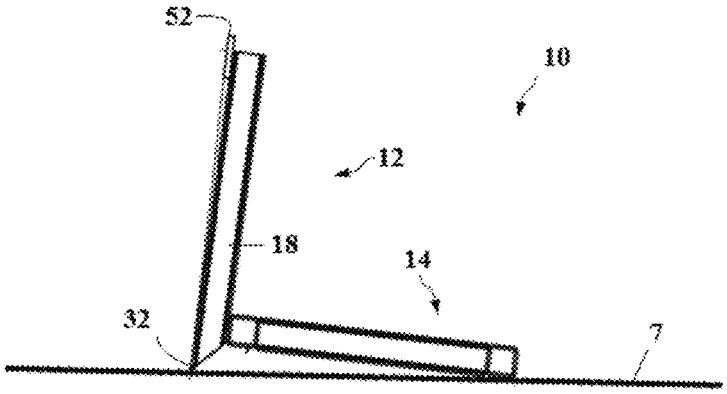

FIGS. 13-15 illustrate an MVB 10 rolling on wedge point 32. In FIGS. 13 and 14 a motor vehicle 74 is impacting MVB 10 traveling from the attack side toward the protected side. Referring specifically to FIG. 13, vehicle 74 is proximate upper portion 14 with the wheels on base 12. Base joists 18 have a length that is sufficient to extend behind the front wheels of vehicle 74 when the front of the vehicle is impacting upper portion 14. In FIG. 14, vehicle 74 has impacted upper portion 14 and MVB 10 is rotating about wedge point 32. As MVB 10 rotates joists 18 contact the undercarriage of vehicle 74 tending to lift vehicle 74 and direct it downward. FIG. 15 illustrates MVB 10 rolled on wedge point 32 with base 12 extending vertically and upper portion 14 is contacting ground 7. Vehicle 74 is removed from FIG. 15 for ease of description. Terminal end 52 is lodged in the undercarriage as shown in FIG. 14. Upper portion 14 is at a declined angle such that the forward motion of vehicle 74 is reacted by the force of the upper portion 14 against ground 7.

Figure 16:
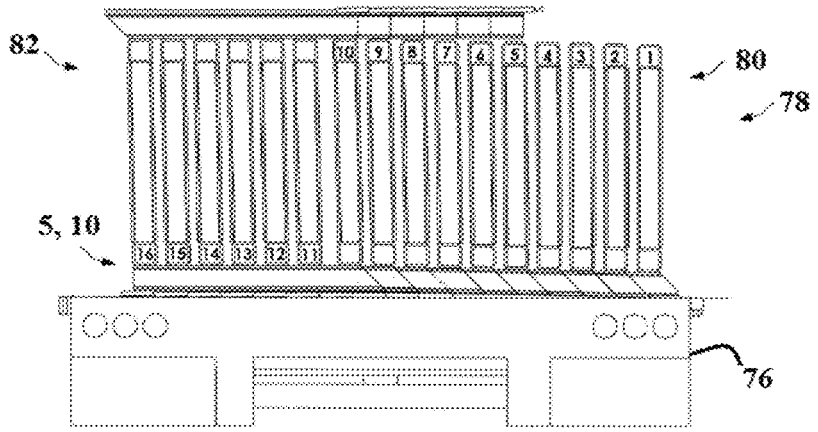
FIGS. 16 and 17 illustrate an exemplary method of transporting modular vehicle barriers.
Figure 17:
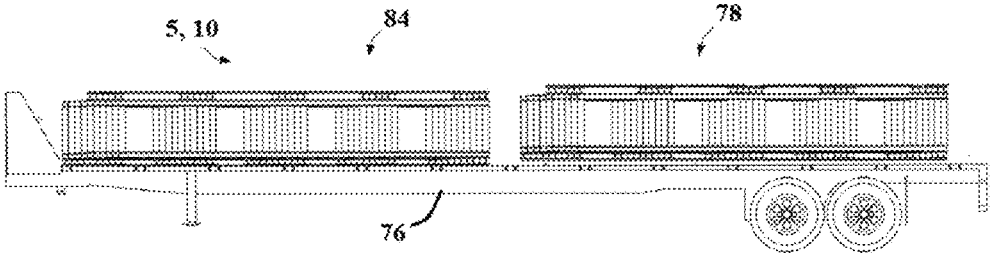

FIGS. 16 and 17 illustrate an example of transporting a plurality of modular vehicle barriers 10 over the road. MVB 10 is configured to maximize the number of units that may be transported on a flatbed trailer 76. According to an embodiment, thirty-two to thirty-three units can be loaded on a trailer 76 and meet highway standards. For example, flatbed trailers 76 are limited to a width of 8.5 feet, 48 to 53 feet in length, and a maximum freight weight of 48,000 pounds.

FIG. 16 is an end view of trailer 76 showing a first group 78 of sixteen 20 foot long units 5. Group 78 includes a first pod 80 and a second pod 82 of units 5. Each pod includes units that are placed with upper portions 14 of adjacent units substantially abutting and the respective lower portions placed one atop of the next. First pod 80 is positioned atop trailer 76 in an upright position with upper portions extending upward from the base. Second pod 82 is inverted so that units 5 are upside down and then mated with first pod 80 on trailer 76. FIG. 17 is a side view of trailer 76 showing two groups 78 and 84 arranged on trailer 76. In this example, first group 78 has sixteen units 5 and second group 84 has seventeen units 5.

The term "approximately" is defined as largely but not necessarily wholly what is specified (and includes what is specified; e.g., approximately 90 degrees includes 90 degrees and approximately parallel includes parallel), as understood by a person of ordinary skill in the art. In any disclosed embodiment, the terms "substantially," "approximately," "generally," and "about" may be substituted with "within [a percentage] of" what is specified, where the percentage may include for example 0.1, 1, and 5 percent as may be recognized by a person skilled in the art.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure and that they may make various changes, substitutions, and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A modular vehicle barrier, comprising:

a rigid, generally L-shaped frame having a base and an upright portion;

the base including two or more joists spaced apart and extending orthogonal to a foot plate, wherein the foot plate is attached to a bottom surface at a front end of the two or more joists;

the upright portion configured in a ladder arrangement having spaced apart vertical posts secured at bottom ends to a bottom beam and at top ends to a top beam, wherein the bottom beam is attached to a top surface at a back end of the two or more joists; and a wedge point formed at the bottom surface of the back end of the two or more joists.

2. The modular vehicle barrier of claim 1, wherein the upright portion is spaced forward of the wedge point toward the front end.

3. The modular vehicle barrier of claim 1, wherein L-shaped frame has a lateral length of approximately 20 feet.

4. The modular vehicle barrier of claim 1, wherein the top beam is attached to top surfaces of the vertical posts whereby the top beam and the vertical posts extend in the same vertical plane.

5. The modular vehicle barrier of claim 1, wherein the top beam is secured to a front face of the vertical posts such that the top beam and the vertical posts are aligned in different vertical planes.

6. The modular vehicle barrier of claim 1, wherein the foot plate elevates the front end of the two or more joists relative to the back end of the two or more joists.

7. The modular vehicle barrier of claim 1, wherein the two or more joists, the vertical posts, the top beam, and the bottom beam are constructed of hollow tubular members and/or I-beams.

8. The modular vehicle barrier of claim 1, wherein the generally L-shaped frame is configured to achieve a crash rating in accordance with ASTM F2656.

9. The modular vehicle barrier of claim 8, wherein the upright portion is spaced forward of the wedge point toward the front end.

10. The modular vehicle barrier of claim 1, wherein the generally L-shaped frame is crash-rated M30-P2 in accordance with ASTM F2656.

11. The modular vehicle barrier of claim 10, wherein the upright portion is spaced forward of the wedge point toward the front end.

12. The modular vehicle barrier of claim 1, wherein the top beam is attached to top surfaces of the vertical posts whereby the top beam and the vertical posts extend in the same vertical plane; and the foot plate elevates the front end of the two or more joists relative to the back end of the two or more joists.

13. The modular vehicle barrier of claim 12, wherein the two or more joists, the vertical posts, the top beam, and the bottom beam are constructed of hollow tubular members and/or I-beams.

14. The modular vehicle barrier of claim 1, wherein the top beam is secured to a front face of the vertical posts such that the top beam and the vertical posts are aligned in different vertical planes; and the foot plate elevates the front end of the two or more joists relative to the back end of the two or more joists.

15. The modular vehicle barrier of claim 14, wherein the two or more joists, the vertical posts, the top beam, and the bottom beam are constructed of hollow tubular members and/or I-beams.

16. The modular vehicle barrier of claim 1, wherein the top beam is constructed of a hollow tubular member and further comprising:

an extension arm that is slidably disposed in a first end of the top beam and configured to mate with an adjacent L-shaped frame; and the upright portion comprising a connector located on a second end opposite the first end, the connector adapted to attach to an extension arm and comprising vertically spaced apart plates.

17. The modular vehicle barrier of claim 16, wherein the foot plate elevates the front end of the two or more joists relative to the back end of the two or more joists; and the top beam and the vertical posts are aligned in a same vertical plane or the top beam and the vertical posts are aligned in different vertical planes.

18. A method comprising:

positioning a modular vehicle barrier (MVB) on a ground surface, the MVB comprising a rigid, generally L-shaped frame having a base positioned on the ground and an upright portion, the base including two or more joists spaced apart and extending orthogonal to a foot plate, wherein the foot plate is attached to a bottom surface at a front end of the two or more joists, the upright portion configured in a ladder arrangement having spaced apart vertical posts secured at bottom ends to a bottom beam and at top ends to a top beam, wherein the bottom beam is attached to a top surface at a back end of the two or more joists, and a wedge point formed at the bottom surface of the back end of the two or more joists.

19. The method of claim 18, further comprising crashing a motor vehicle traveling in a direction from the front end to the back end into the upper portion; and stopping the vehicle within less than about 23 feet of the top beam to achieve a crash rating in accordance with ASTM F2656.

20. The method of claim 19, wherein the motor vehicle was approximately 15,000 pounds and traveling at approximately 30 miles per hour when it impacts the upper portion.

* * * * *